US006722308B1

(12) United States Patent
Moulden

(10) Patent No.: US 6,722,308 B1
(45) Date of Patent: Apr. 20, 2004

(54) CLAPPER ASSEMBLY FOR A HANDBELL

(75) Inventor: Steven C. Moulden, West Chester, PA (US)

(73) Assignee: Schulmerich Carillons, Inc., Sellersville, PA (US)

( * ) Notice: Subject to any disclaimer, the term of this patent is extended or adjusted under 35 U.S.C. 154(b) by 0 days.

(21) Appl. No.: 10/404,341

(22) Filed: Apr. 1, 2003

(51) Int. Cl.[7] ..... G10K 1/071; G10K 1/072

(52) U.S. Cl. ..... 116/171

(58) Field of Search ..... 116/171, 148, 116/149, 150, 170, 154, 155, 156; 84/406, 407

(56) References Cited

U.S. PATENT DOCUMENTS

| | | | | |
|---|---|---|---|---|
| 2,571,178 A | * 10/1951 | Allen | ..... | 340/398.1 |
| 3,139,855 A | 7/1964 | Kunz | ..... | 116/171 |
| 3,207,124 A | 9/1965 | Malta | ..... | 116/171 |
| 3,253,574 A | 5/1966 | Malta | ..... | 116/171 |
| 3,941,082 A | 3/1976 | Malta | ..... | 116/171 |
| 4,062,317 A | 12/1977 | Malta | ..... | 116/171 |
| 4,121,534 A | 10/1978 | Malta | ..... | 116/171 |
| 4,466,329 A | 8/1984 | Hayward | ..... | 84/406 |
| 4,566,400 A | 1/1986 | Keenan et al. | ..... | 116/171 |

FOREIGN PATENT DOCUMENTS

JP 2003280665 A * 10/2003 ..... G10K/1/06

OTHER PUBLICATIONS

Vlier–Spring Loaded Devices, 1 page, Feb. 2003.

3M BUMPON Protective Products, 8 page brochure, Jan. 2003.

Schulmerich Handbells, 4 page brochure, Jun. 2000.

Schulmerich Handbells, MelodyChime® Instruments, & Accessories 2002, 6 page brochure, Jun. 2002.

Jergens Inc. Catalog—Spring Plungers, 3 pages, Jan. 2003.

* cited by examiner

*Primary Examiner*—Diego Gutierrez
*Assistant Examiner*—R. Alexander Smith
(74) *Attorney, Agent, or Firm*—Howson and Howson

(57) ABSTRACT

A handbell having an improved clapper assembly. The handbell includes a bell body in which the clapper assembly is mounted, and the clapper assembly has a compact construction including a yoke secured to a closed end of the bell body and a clapper mounted for swinging movement relative to the yoke along a path defining a forward swing direction and a back swing direction. The clapper has a head for striking the bell body and a pivot block pivotally mounted to the yoke. The pivot block carries at least one energy absorber that is engageable with the yoke during at least part of the swinging movement of the clapper for controlling the swinging movement of the clapper in one of the forward swing or back swing directions. Preferably, the clapper carries a pair of energy absorbers.

27 Claims, 4 Drawing Sheets

CLAPPER ASSEMBLY FOR A HANDBELL

FIELD OF THE INVENTION

The present invention relates to a handbell having a clapper assembly, and more particularly, the present invention relates to a clapper assembly useful with, but not limited to, handbells having relatively small bell bodies that have limited internal dimensions.

BACKGROUND OF THE INVENTION

Handbells are disclosed, for example, in U.S. Pat. Nos. 3,941,082, 4,062,317, 4,566,400, 4,466,329, 3,253,574, 3,139,855, 3,207,124, and 4,121,534. Handbells generally include a bell body, or bell casting, typically made of bronze, a clapper assembly mounted within the bell body for striking the bell body, and a handle such as a strap used by a player to grasp and play the handbell. Clapper assemblies provide a means for striking (ie., ringing, playing, etc.) the bell body and also prevent undesired contact of the clapper assembly with the bell body so that the desired tonal qualities produced by the handbell is unaltered by the clapper assembly. Conventional handbells utilize various restraining mechanisms to control the swinging movement of the clapper within the bell body and prevent the clapper from contacting the bell body unless a predetermined amount of strike force is applied to the clapper to strike the bell body.

Handbells are carefully manufactured and tuned so that different handbells produce different desired notes of the musical scale. For example, a set of at least eighty-five handbells may be provided such that each bell produces a different note for notes spanning the first through seventh octaves of the musical scale. The size, weight, and shape of the bell bodies of the handbells vary depending upon the desired musical note to be produced. For example, a bell body utilized to produce a C2 note in the lower seventh octave may weigh 18 pounds and be relatively large; whereas, a bell body utilized to produce a C9 note in the upper seventh octave may weigh less than a pound and be relatively small. Of course, the available space within relatively small bell bodies, for instance bell bodies of the upper sixth and seventh octaves, provides limited area for clapper assemblies and restraining means thereof.

One conventional clapper assembly that has been used commercially for well over a decade and that is particularly suited for use in small bell bodies has a yoke containing a stationary compressible rubber disc that extends transversely relative to a shaft of the clapper. The disc has a central slot through which the clapper shaft extends and pivots in forward swing and back swing directions. The frictional engagement of the rubber disc and swinging shaft restrains the stroke of the clapper, and the disc can be compressed to adjust the strike force needed to ring the bell body. The force required to strike the bell is equal in both the forward swing and back swing directions.

Although the handbells, clapper assemblies, and restraining mechanisms to control the swinging movement of clappers within bell bodies disclosed above and in referenced patents may function satisfactorily for their intended purposes, there remains a need for an improved clapper assembly particularly suited for, but not limited to, use with handbells having relatively small bell bodies. Preferably, the clapper assembly should be compact and capable of being mounted and properly operated within a small space and should carry a mechanism for limiting the stroke of the clapper when clapper contact with the bell body is undesired. The stroke-limiting mechanism should permit adjustment of the amount of force required to cause the clapper to strike the bell body within a range of forces. Preferably, the strike force in a forward swing direction should be independently adjustable relative to the strike force in a back swing direction, and the adjustments should be capable of being readily accomplished with a minimum of skill and labor and without disassembly of the handbell. In addition, the clapper assembly should be reliable, long lasting, provide silent operation, and be inexpensive to manufacture.

OBJECTS OF THE INVENTION

With the foregoing in mind, a primary object of the present invention is to provide an improved clapper assembly for bell bodies, or castings, of all sizes, weights, and shapes including those having relatively small bell bodies.

Another object of the present invention is to provide a handbell having a compact clapper assembly carrying a mechanism for limiting the stroke of the clapper when clapper contact with the bell body is undesired.

A further object of the present invention is to provide a clapper assembly having a clapper stroke-limiting mechanism that is adjustable so that an amount of force required to cause the clapper to strike the bell body can be set within a range of forces and so that adjustment for controlling clapper movement in forward swing direction can be set independently of that for controlling clapper movement in a back swing direction.

A still further object of the present invention is to provide a clapper assembly that provides silent and reliable operation throughout the useful life of the handbell.

SUMMARY OF THE INVENTION

More specifically, the present invention provides a handbell including a bell body and a novel clapper assembly carried within the bell body. The clapper assembly includes a yoke secured to a closed end of the bell body and a clapper mounted for swinging movement relative to the yoke along a path defining a forward swing direction and a back swing direction. The clapper includes a head for striking the bell body and a pivot block for pivotally mounting the clapper to the yoke. The pivot block carries at least one energy absorber that is engageable with the yoke during at least part of the swinging movement of the clapper for controlling the swinging movement of the clapper in one of the forward swing or back swing directions.

In a preferred embodiment, the energy absorber has a body adjustably secured to the pivot block for movement therewith, a displaceable plunger at an end of the body, and a means for resiliently urging the plunger in an extended position such that the plunger is engageable with the yoke for controlling the swinging movement of the clapper. In addition, preferably the clapper carries a pair of energy absorbers such that one of the energy absorbers independently controls the swinging movement of the clapper in the forward swing direction and the other of the energy absorbers independently controls the swinging movement of the clapper in the back swing direction. Further, preferably the swinging movement of the clapper is within a predetermined plane, and the pair of energy absorbers are mounted on the pivot block on opposite sides of the clapper shaft and within the predetermined plane.

According to another aspect of the present invention, a clapper assembly as discussed above is provided.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
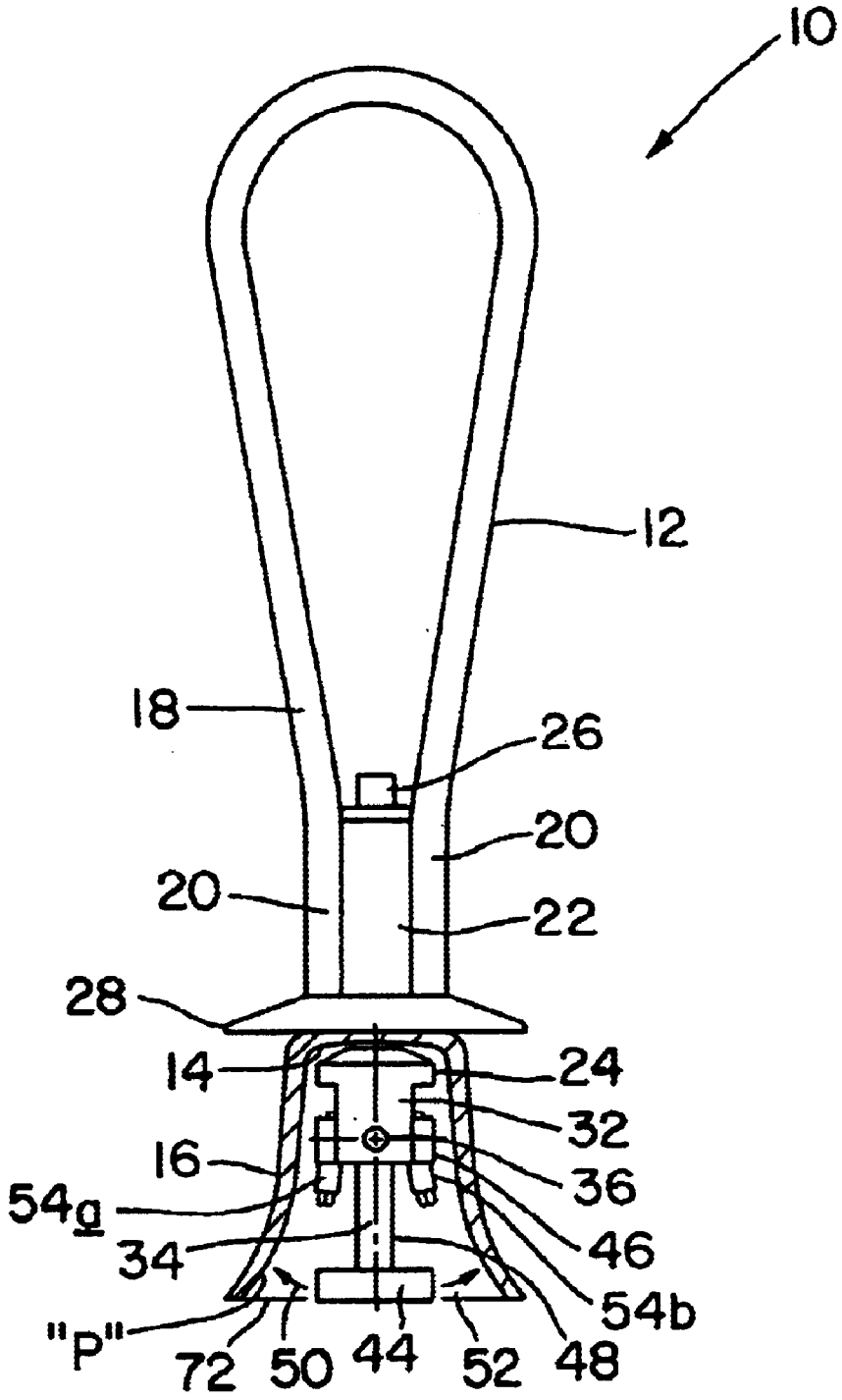
FIG. 1 is a partially cut-away front elevational view of a handbell according to the present invention.
Figure 2:
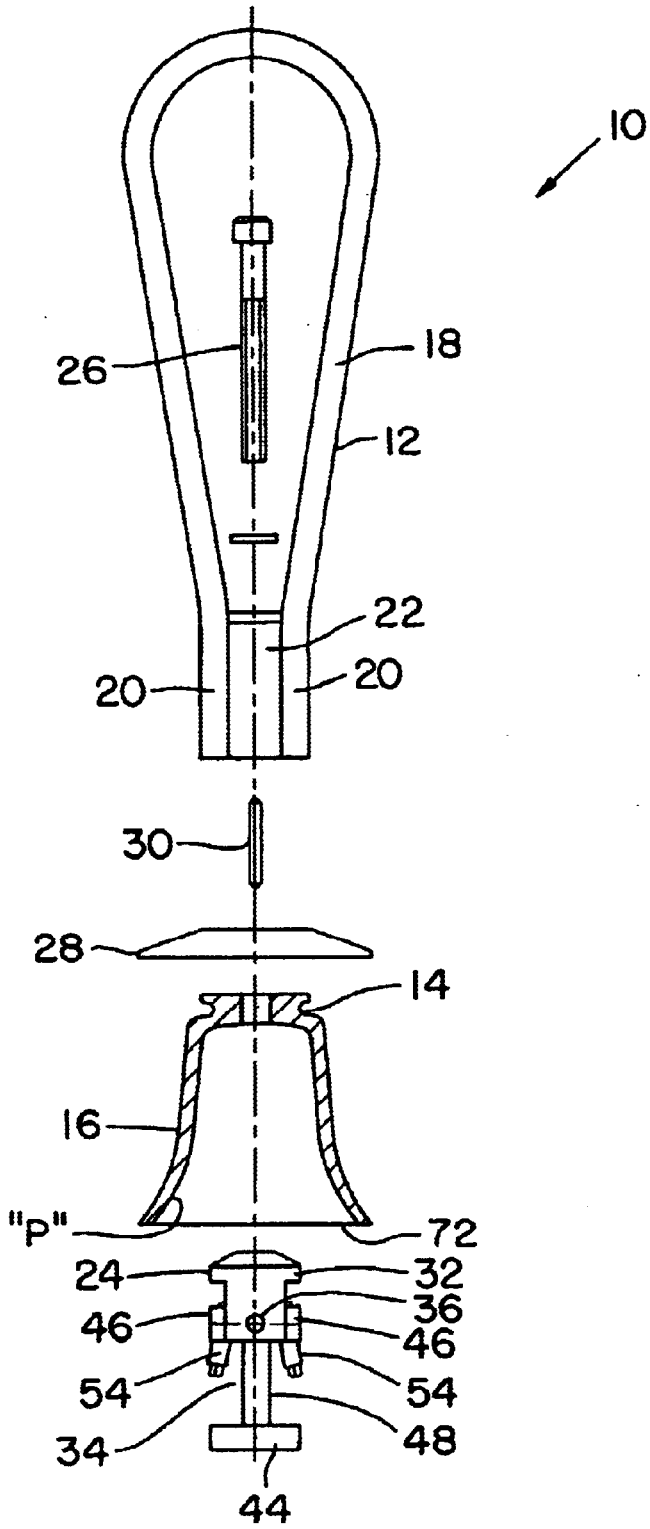
FIG. 2 is an exploded elevational view of the handbell illustrated in FIG. 1.

Referring now to the drawings, FIGS. 1 and 2 illustrate a handbell 10 according to the present invention. To this end, a handle assembly 12 projects from a closed end 14 of a bell body, or bell casting, 16 and provides a grip location for a hand of a player of the handbell 10. The handle assembly 12 includes a strap-style handle 18 having ends 20 secured to a handle block 22 typically with a set of rivets or the like (not shown). A cap screw 26 secures the handle block 22 to a clapper assembly 24 that is positioned within the bell body 16 and captures the bell body 16 and a handguard disc 28 therebetween.

Preferably, a locating, or index, pin 30 is captured and embedded within the handbell 10 and functions to properly align and prevent relative rotational movement of the handle assembly 12, clapper assembly 24 and bell body 16 so that a strike point "P" is defined on the bell body 16. The pin 30 extends substantially parallel to the cap screw 26 and is laterally spaced therefrom. Typically, the pin 30 is displaced out of a plane of swing of the clapper such that the pin 30 is located within a plane that extends through a central longitudinal axis of the handbell 10 and that is offset to the plane of swing by about 90°. The strike point "P" is selected during manufacture of the handbell 10 to assure that optimal tonal quality and pitch is produced by the handbell 10. If desired, the bell body 16 can also be struck at a point on the bell body 16 diametrically opposite point "P" during a back swing of the clapper.

In use, the handle 18 is gripped by the hand of a player, and a musical note is generated when the player causes the clapper assembly 24 to strike the bell body 16. This is typically accomplished when the player twists his/her wrist causing the handbell 16 to pivot and then come to a sudden stop. The force exerted by this movement causes the clapper assembly 24 to strike the bell body 16. However, after the clapper assembly 24 strikes the bell body 16 it must retract from the bell body 16 and not rest or otherwise contact the bell body 16 or it will undesirably dampen the sound produced by the vibrating bell body. In addition, the clapper assembly 24 should not strike, contact or rest on the bell body 16 when sufficient striking force is not applied.

For purposes of example, the bell body 16 illustrated in FIGS. 1 and 2 is relatively small and typical of a bell body used to generate musical notes in the upper sixth and seventh octaves of the musical scale. Of course, the clapper assembly 24 according to the present invention can also be utilized in larger bell bodies and is not limited to use in small bells. As an example of a small bell body 16, the closed end 14 of the bell body 16 may have an inside diameter, for instance, of about 0.875 inch or less. Thus, the available space within the bell body 16 to mount and operate the clapper assembly 24 is relatively small. This, in turn, requires use of a relatively compact clapper assembly. Known clapper assemblies utilized in larger bell bodies are not necessarily capable of reliable use in bell bodies of smaller sizes since such clapper assemblies require greater room for mounting and proper operation.

Figure 3:
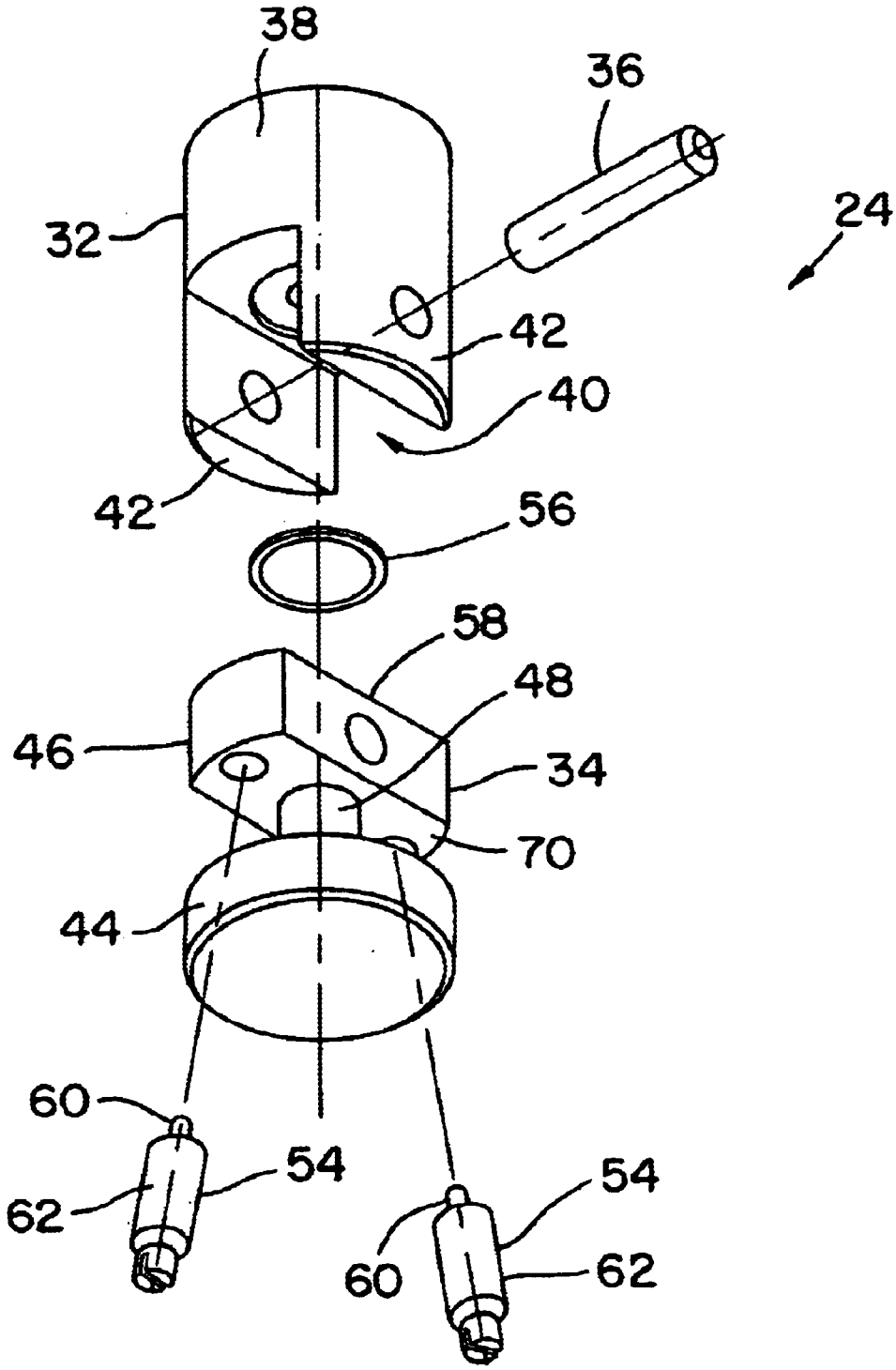
FIG. 3 is an exploded perspective view of the clapper assembly of the handbell illustrated in FIG. 1.

The clapper assembly 24 of the present invention is best illustrated in FIG. 3 and includes a yoke 32 and a clapper 34 connected to the yoke 32 with one or more pivot pins 36 or the like. The yoke 32 has a compact bifurcated body 38 with an open slot 40 formed therein defining a pair of opposed arms 42. The clapper 34 includes a head 44 for striking the bell body 16, a pivot block 46 for interconnection to the yoke 32, and a shaft 48 extending between the head 44 and pivot block 46. The pivot block 46 is received within the open slot 40 between the arms 42 of the yoke 32, and preferably, the pivot pin 36 extends through the arms 42 and pivot block 46 to attach the clapper 34 to the yoke 32.

The yoke 32 is affixed to the closed end 14 of the bell body 16 in a stationary position, and the clapper 34 is free to pivot in swinging movements about the pivot pin 36. Thus, the clapper 34 can swing in an arcuate path in a forward swing direction toward point "P" as shown by arrow 50 in FIG. 1 or in a reverse, or back swing, direction as shown by arrow 52 in FIG. 1. The swinging movement of the clapper 34 is within a predefined plane relative to the bell body 16 so that the clapper 34 can strike in point "P" of the bell body 16.

The clapper assembly 24 provides an energy absorbing means, or energy absorber, 54 for controlling the swinging movements of the clapper 34 such that the clapper 34 is prevented from contacting the bell body 16 when contact is undesired. For example, after the clapper 34 strikes the bell body 16, the energy absorber 54 prevents the clapper 34 from resting on the bell body 16 and from contacting the bell body 16 on its reverse swing. This ensures that the vibration of the bell body 16 is not dampened by contact with the clapper 34. The energy absorber 54 also prevents inadvertent striking of the bell body 16 such as when the handbell 10 is simply being handled or when the handbell 10 is simply repositioned by a handbell player without intending to generate a musical note.

As illustrated in FIG. 1, the preferred embodiment of the clapper assembly 24 utilizes a pair of energy absorbers 54, one 54*a* for controlling the swing of the clapper 34 in a forward swing direction 50 and the other 54*b* for controlling the swing of the clapper 34 in the back swing direction 52. The energy absorbers 54 are mounted on the pivot block 46 on opposite sides of the shaft 48 and each extends within the predefined plane in which the clapper 34 swings and the strike point "P" lies. Thus, the energy absorbers 54 swing in an arcuate path with the pivot block 46 about an axis defined by the pivot pin 36 and limit the extent of the swing of the clapper 34 by engaging a surface of the yoke 32 when the head 44 of the clapper 34 approaches the bell body 16. Preferably, a separate bumper 56 made of a soft plastic, rubber, or like resilient material is affixed to the yoke 32 and provides the surface of the yoke 32 that engages the energy absorbers 54 to ensure that the impact of the energy absorber 54 on the yoke 32 is silent.

Each energy absorber 54 has a displaceable portion, or plunger, 60 that projects beyond a surface 58 of the pivot block 46 facing the yoke 32 and that can come into contact with the bumper 56. Each retractable plunger 60 is resiliently urged in an extended position, as illustrated, and only becomes displaced when the impact of the plunger 60 with the bumper 56 is of a sufficient force. The displacement of the plunger 60 effectively increases the extent of swing of the clapper 34 and permits the clapper 34 to strike the bell body 16. Thus, the plungers 60 limit the swing of the clapper 34 so that the head 44 of the clapper 34 cannot contact the bell body 16 when striking the bell body 16 is not desired, and the plunger 60 of energy absorber 54*a* is displaced, or depressed, during its impact with the bumper 56 to permit the head 44 of the clapper 34 to strike the bell body 16 when a sufficient amount of strike force is applied during an intended strike condition. After the strike, the plunger 60 is resiliently urged into its original and normal extended position to prevent the head 44 of the clapper 34 from resting or otherwise contacting the vibrating bell body 16.

Figure 4:
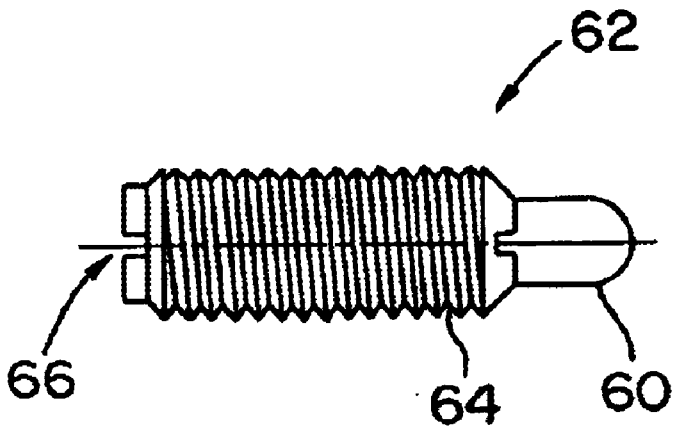
FIG. 4 is an elevational view of an energy absorber useful in the clapper assembly of the present invention.
Figure 5:
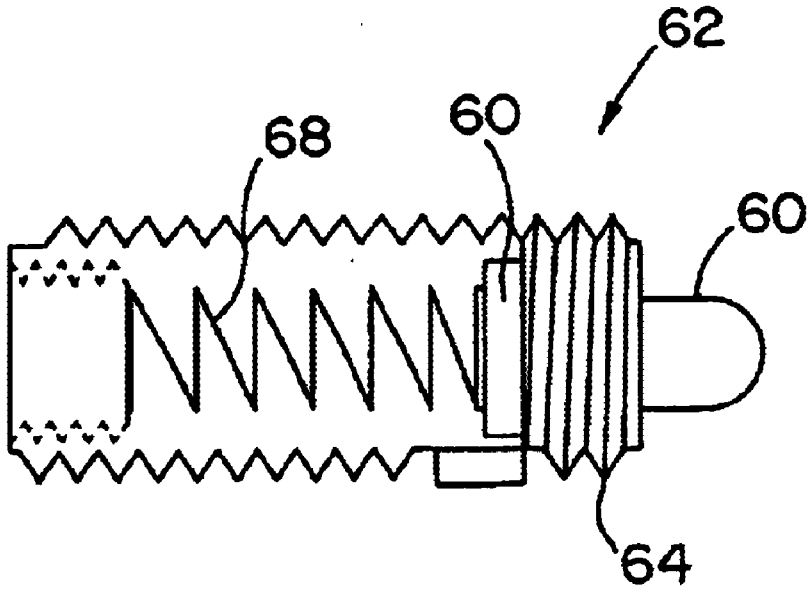
FIG. 5 is a partial cross-sectional view of an energy absorber useful in the clapper assembly of the present invention.

One example of a device for use as an energy absorber 54 in the clapper assembly 24 of the present invention is a so-called "spring plunger" 62 best illustrated in FIGS. 4 and 5. Each spring plunger 62 has an elongate threaded body 64, a displaceable plunger 60 at one end thereof, and an engageable surface 66 at an opposite end thereof. A spring 68, such as a helical spring, provides a force for resiliently urging the plunger 60 in an extended position, as shown in FIGS. 4 and 5, and also permits the plunger 60 to be retracted completely within the body 64 when the plunger 60 is applied with a force opposite and greater than the force applied by the spring 68. While the helical spring 68 provides one example of a means for resiliently urging the plunger 60 into an extended position, other means can also be utilized for this function, such as, metal springs, leaf springs, compressible materials, elastomeric materials, gas springs, hydraulic springs, and the like.

Preferably, the length of the elongate spring plunger 62 is greater than the width of the pivot block 46 to which it is mounted. This insures that the plunger 60 extends from the surface 58 of the pivot block 46 facing the yoke 32 and that the engageable surface 66 at an opposite end of the spring plunger 62 projects from a surface 70 of the pivot block 46 facing the open end 72 of the bell body 16.

The engageable surface 66 can be provided, for instance, as a slot 74 that is engageable with a screwdriver or like tool to rotate the spring plunger 62 relative to the pivot block 46. Alternatively, the engageable surface 66 can be provided as flats defined by a depression or projection that is engageable with a wrench or like tool, or can be provided as a surface engageable with a finger of a person. Since the engageable surface 66 faces the open end 72 of the bell body 16 and projects from the pivot block 46, it can be readily accessed without disassembly of the handbell 10.

Each energy absorbers 54 is adjustably secured to the pivot block 46 to enable independent adjustment of the spacing provided between each energy absorber 54 and the yoke 32. Manipulation of the engageable surface 66 of each energy absorber 54 permits the adjustment to be accomplished. For example, in the illustrated embodiment the threaded body 64 of the spring plunger 62 is mounted to the pivot block 46 via its threads, and its distance from the yoke 32 is adjusted by rotation of the spring plunger 62 relative to the pivot block 46. Of course, other means for adjustably mounting the energy absorbers 54 to the pivot block can be utilized.

Each energy absorber 54 can be displaced in a direction toward the yoke 32 to increase the striking force required for the head 44 to strike the bell body 16 and in a direction away from the yoke 32 to decrease the striking force required for the head 44 to strike the bell body 16. The control of the swinging movement provided by each of the energy absorbers, 54*a* and 54*b*, is independently adjustable such that the control provided by one of the energy absorbers 54*a* can be adjusted to be greater than, less than, or the same as the control provided by the other energy absorber 54*b*. For example, the energy absorbers 54*a* and 54*b* can be adjusted such that, when the clapper 34 is in a neutral, or centrally-located, position in which the clapper head is spaced equal distances from the bell body in both the forward swing 50 and back swing 52 directions, one of the energy absorbers, 54*a* or 54*b*, can be spaced closer to the yoke 32 than the other energy absorber 54*b*. Thus, the swinging movement of the clapper 34 permitted by the energy absorbers 54*a* and 54*b* can be asymmetrical about the neutral position.

The spring plungers 62 can be utilized to control the swing of the clapper 34 without requiring significant space for proper mounting and operation. To this end, the spring plungers 62 are not required to extend laterally to any great extent from the clapper assembly 24 when mounted or during proper operation. Preferably, the elongate spring plungers 62 are located close to the shaft 48 of the clapper 34 and extend only at a slight angle relative to the shaft 48 to ensure that each plunger 60 is substantially square to the bumper 56 of the yoke 32 when the plunger 60 engages the bumper 56 during the outer limits of the stroke of the clapper 34. Thus, the spring plungers 62 are particularly suited for, but not limited to, use in relatively small sized bell bodies where space within the bell body is extremely limited and in which any laterally-extending part of a clapper assembly will undesirably contact the bell body.

While a spring plunger 62 provides one example of an energy absorber 54 for use in the clapper assembly 24 of the present invention, other energy absorbing devices are contemplated for use. For example, the helical spring of the spring plunger can be replaced with other mechanisms, such as, a leaf spring or any other compressible material capable of reliably and quickly expanding to an original extended shape. In addition, shock absorber devices can be utilized such as those that contain a fluid or the like to extend/compress the device.

By way of example, and not be way of limitation, the clapper assembly 24 can be used in a handbell 10 that provides a musical note in the upper sixth or seventh octaves of the musical scale. Of course, the clapper assembly 24 can also be utilized in any handbell regardless of size, shape and/or weight. The yoke 32 can be made of a molded polycarbonate material that has an outermost diameter of about ⅝ inch and a length of about ⅞ inch. A hemisphere-shaped bumper 56 made of polyurethane can be press fit into a recess formed in a centrally-located surface of the yoke 32 between the arms 42. Bumpers made of natural rubber, synthetic rubber, acrylic or the like and of various shapes can also be utilized provided that they create a long lasting surface that can engage the energy absorbers 54 in a sound deadening manner. The clapper 34 can be made of an alloy brass material as an integral component and have a length of between about 0.75 and 0.813 inch and an outermost diameter of between about ⅝ to ¾ inch. The shaft 48 can be cylindrical and have a diameter of about ¼ inch, and the pivot block 46 can have an outermost diameter of about ⅝ inch, a width of about 0.313 inch, and a thickness of about ¼ inch. The energy absorbers 54 can be spring plungers 62 manufactured and sold by Jergens Inc, of Cleveland, Ohio and can provide a plunger that retracts when applied with between about 0.5 to 1.5 pounds of force. The spring plungers 62 can have a steel body, an internal helical spring, a total length of about 7⁄16 inch when in a fully extended condition, and a plunger made of Delrin that extends about 1/16 inch from the body when in an extended position.

Thus, the above-described handbell 10 has an improved clapper assembly 24 that is compact and capable of being mounted and operated within a relatively small space and carries at least one energy absorber for limiting the stroke of the clapper when clapper contact with the bell body is undesired. The energy absorbers permit adjustment of the amount of force required to cause the clapper to strike the bell body within a range of forces, and the adjustment is capable of being readily accomplished with a minimum of skill and labor and without disassembly of the handbell. In addition, where a pair of energy absorbers are carried by the clapper, each energy absorber is independently adjustable relative to the other energy absorber. The clapper assembly 24 is reliable and provides silent operation throughout a long useful life.

While a preferred handbell and clapper assembly have been described in detail, various modifications, alterations, and changes may be made without departing from the spirit and scope of the handbell and clapper assembly according to the present invention as defined in the appended claims.

What is claimed is:

1. A handbell, comprising:

a bell body having an open end and a clapper assembly carried within said bell body;

said clapper assembly including a yoke secured to a closed end of said bell body and a clapper mounted for swinging movement relative to said yoke along a path defining a forward swing direction and a back swing direction;

said clapper including a head for striking said bell body and a pivot block mounted to said yoke; and said pivot block of said clapper carrying at least one energy absorber having a retractable plunger that is engageable with said yoke for controlling said swinging movement of said clapper in one of said forward swing and back swing directions.

2. A handbell according to claim 1, wherein said energy absorber is carried on said pivot block at a location relative to said clapper head to afford adjustment of said swinging movement of said clapper by means inserted into said open end of said bell body and therein engaged with said energy absorber.

3. A handbell according to claim 2, wherein an end of said energy absorber extends from said pivot block toward said clapper head.

4. A handbell according to claim 1, wherein said energy absorber has a body and said retractable plunger faces said yoke.

5. A handbell according to claim 4, wherein, under non-bell-striking conditions, said plunger is resiliently urged and positioned in an extended position from said body so that said energy absorber prevents said clapper from striking said bell body.

6. A handbell according to claim 4, wherein, under a bell-striking condition, said plunger is displaced with respect to said body so that said energy absorber permits said clapper to swing to an extent such that said clapper head strikes said bell body.

7. A handbell according to claim 1, wherein said energy absorber has a body adjustably secured to said pivot block, and a means to resiliently urge said plunger in an extended position.

8. A handbell according to claim 1, wherein said yoke includes a bumper that provides a surface for engaging said energy absorber in a sound deadening manner, and wherein said bumper is made of a material selected from a group consisting of polyurethane, natural rubber, synthetic rubber, an acrylic material, and a soft plastic material.

9. A handbell according to claim 1, wherein said pivot block of said clapper carries a pair of said energy absorbers that are engageable with said yoke such that one of said energy absorbers controls said swinging movement of said clapper in said forward swing direction and the other of said energy absorbers controls said swinging movement of said clapper in said back swing direction.

10. A handbell according to claim 9, wherein said control of said swinging movement provided by each of said energy absorbers is independently adjustable, whereby said control provided by one of said energy absorbers can be adjusted to be greater than, less than, or the same as said control provided by the other of said energy absorbers.

11. A handbell according to claim 10, wherein, when said clapper is in a neutral position in which the clapper head is spaced equal distances from said bell in both said forward swing and back swing directions, one of said energy absorbers is spaced closer to said yoke than the other of said energy absorbers.

12. A handbell according to claim 9, wherein said swinging movement of said clapper is within a predetermined plane, wherein said clapper has a shaft that extends between said pivot block and said head, and wherein said energy absorbers are mounted to said pivot block on opposite sides of said shaft and within said predetermined plane.

13. A handbell according to claim 12, wherein said yoke has an open slot extending therethrough in which said pivot block of said clapper is pivotally mounted.

14. A handbell, comprising:

a bell body having an open end and a clapper assembly carried within said bell body;

said clapper assembly including a stationary yoke centrally secured to a closed end of said bell body and a clapper mounted for swinging movement relative to said yoke along a defined path of motion in a forward swing direction and a back swing direction;

said clapper including a head for striking said bell body and a pivot block mounted to said yoke, and a shaft connecting said head to said pivot block; and said pivot block of said clapper carrying at least one energy absorber having a body, a displaceable plunger at an end of said body, and means for resiliently urging said plunger in an extended position such that said plunger is engageable with said yoke for controlling said swinging movement of said clapper in one of said forward swing or back swing directions.

15. A handbell according to claim 14, wherein, under non-bell-striking conditions, said plunger is resiliently urged and positioned in an extended position from said energy absorber body so that said energy absorber limits said swinging movement of said clapper and said clapper head is prevented from striking said bell body, and wherein, under a bell-striking condition, said plunger retracts with respect to said energy absorber body so that said energy absorber permits said clapper to swing to an extent such that said clapper head strikes said bell body.

16. A handbell according to claim 15, wherein said pivot block of said clapper carries a pair of said energy absorbers such that one of said energy absorbers controls said swinging movement of said clapper in said forward swing direction and the other of said energy absorbers controls said swinging movement of said clapper in said back swing direction.

17. A handbell according to claim 16, wherein positioning of each of said energy absorbers on said pivot block relative to said yoke is independently adjustable, whereby said control provided by one of said energy absorbers can be adjusted to be greater than, less than, or the same as said control provided by the other of said energy absorbers.

18. A handbell according to claim 17, wherein an end of each of said energy absorbers opposite said plunger extends from said pivot block toward an open end of said bell body and said clapper head and is engageable so that adjustment of said energy absorber is capable without disassembly of the handbell.

19. A handbell according to claim 18, wherein said yoke has an open slot extending therethrough in which said pivot block of said clapper is pivotally mounted, wherein said swinging movement of said clapper shaft is within a predetermined plane, and wherein said energy absorbers are mounted to said pivot block on opposite sides of said clapper shaft and within said predetermined plane.

20. A handbell according to claim 19, wherein said yoke includes a bumper located centrally within said open slot and providing a surface for engaging said plungers of said energy absorbers in a sound deadening manner, wherein said bumper is made of a material selected from a group consisting of polyurethane, natural rubber, synthetic rubber, an acrylic material, and a soft plastic material.

21. A clapper assembly for a handbell, comprising:

a yoke and a clapper mounted to said yoke;

said clapper having a pivot block mounted to said yoke in a manner permitting swinging movement of said clapper relative to said yoke within a defined path of movement in a forward swing direction and a back swing direction;

said pivot block of said clapper carrying at least one energy absorber having a retractable plunger that is engageable with said yoke for controlling said swinging movement of said clapper in one of said forward swing and back swing directions.

22. A clapper assembly according to claim 21, wherein said energy absorber has a body adjustably secured to said pivot block for movement therewith, and means for resiliently urging said plunger in an extended position such that said plunger is engageable with said yoke for controlling said swinging movement of said clapper.

23. A clapper assembly according to claim 21, wherein said pivot block of said clapper carries a pair of said energy absorbers such that one of said energy absorbers controls said swinging movement of said clapper in said forward swing direction and the other of said energy absorbers controls said swinging movement of said clapper in said back swing direction.

24. A clapper assembly according to claim 23, wherein positioning of each of said energy absorbers on said pivot block relative to said yoke is independently adjustable, whereby said control provided by one of said energy absorbers can be adjusted to be greater than, less than, or the same as said control provided by the other of said energy absorbers.

25. A clapper assembly according to claim 24, wherein said clapper includes a clapper shaft extending from said pivot block to a clapper head, wherein said swinging movement of said clapper is within a predetermined plane, and wherein said energy absorbers are mounted to said pivot block on opposite sides of said clapper shaft and within said predetermined plane.

26. A clapper assembly according to claim 25, wherein said yoke is bifurcated forming an open slot therethrough in which said pivot block is pivotally mounted.

27. A clapper assembly according to claim 26, wherein said yoke includes a bumper located centrally within said open slot and providing a surface for engaging said plungers of said energy absorbers in a sound deadening manner, wherein said bumper is made of a material selected from a group consisting of polyurethane, natural rubber, synthetic rubber, an acrylic material, and a soft plastic material.

* * * * *